United States Patent [19]

Bernaerts

[11] 4,227,677

[45] Oct. 14, 1980

[54] ANTI-SWAY DEVICE FOR HOISTS AND CRANES

[76] Inventor: Henry J. Bernaerts, R.F.D. 10, 1610 Laurel La., Annapolis, Md. 21401

[21] Appl. No.: 23,554

[22] Filed: Mar. 26, 1979

[51] Int. Cl.[3] ..... B66D 1/00

[52] U.S. Cl. ..... 254/264; 242/107.13

[58] Field of Search ..... 254/167, 184, 186 R, 254/187.4, 175.3, 175.7

[56] References Cited

U.S. PATENT DOCUMENTS

| | | | |
|---|---|---|---|
| 2,726,828 | 12/1955 | Pashkow | 242/156 |
| 3,182,962 | 5/1965 | Gray | 254/167 X |
| 3,743,107 | 7/1973 | Verschoof | 254/184 |

*Primary Examiner*—Edward J. McCarthy
*Attorney, Agent, or Firm*—R. S. Sciascia; Q. E. Hodges

[57] ABSTRACT

This anti-sway device uses roller chains to greatly restrict the lateral movement of the lifting lines suspended from hoists or cranes. The roller chain is suspended parallel to the lifting lines or lifting chains. One end is attached to the free end of the lifting lines. The other end of the roller chain is wound around a takeup reel which prevents the roller chain from going slack. Since roller chains tend to be very stiff in a direction parallel to the pivotal axes of the roller links, the roller chain will tend to prevent the lifting lines from moving in the plane of the pivotal axes of the roller links.

9 Claims, 4 Drawing Figures

ANTI-SWAY DEVICE FOR HOISTS AND CRANES

The invention described herein may be manufactured and used by or for the Government of the United States of America for governmental purposes without the payment of any royalties thereon or therefor.

BACKGROUND OF THE INVENTION

The field of this invention generally includes hoists and cranes and in particular it includes devices for addition to existing hoists and cranes to prevent the suspended ends of their lifting lines from swaying laterally. In many applications where cranes and hoists are used, it is important that the suspended ends of the lifting lines do not sway laterally. Such lateral swaying can result from movements of the crane or hoist or from forces acting directly on the lifting lines or on the object being lifted. The most common prior art approach to preventing such lateral swaying has been to use several lifting lines attached to the same object with the lifting lines suspended at different angles to form an inverted pyramid pattern. This approach requires that the hoist or crane have several extra takeup reels, pulleys and structures to support the required synchronized or controlled high torque reels. These reels have to be powered or equipped with damping brakes. It would be very difficult if not impossible to modify most existing hoists or cranes to be anti-sway by adding such additional lifting lines to make such an inverted pyramid. It is one of the objectives of this invention to provide a device for existing hoists or cranes with which these hoists or cranes may be modified to limit the lateral swaying of the suspended ends of their lifting lines.

It is another objective of this invention to provide such an anti-sway device that is relatively simple and easy to operate.

It is another objective of this invention to provide such an anti-sway capability in a second vertical tangential plane for boom cranes which already have a conventional tagline type anti-sway system in a radial vertical plane through the crane's vertical revolvement axis.

It is another objective of this invention to provide an anti-sway device which can perform the alternative function of serving as an independent failsafe load holding device.

SUMMARY OF THE INVENTION

Lateral stiffness is provided for the suspended end of a lifting line in a crane or hoist by attaching one end of a roller chain to the suspended end of the lifting line and hanging the roller chain parallel to the lifting line. Such roller chains are characterized by having their link pivot axes parallel and therefor will tend to be very stiff in any direction which is parallel to the pivotal axes of its rollers, the suspended end of both the roller chain and the lifting line will be restrained and will not sway in the plane of the roller chain. A takeup reel for the roller chain is mounted immediately above or below the upper support of the hoist or crane from which the lifting line is suspended. A bias torque is applied to the takeup reel of the roller chain so that it will constantly pull upward on the roller chain to take up any slack in it. A plurality of roller chains and takeup reels may be mounted at right angles and used in the anti-sway device to provide additional stiffness to the suspended end of the lifting line and to provide the lifting line with lateral stiffness in two directions.

BRIEF DESCRIPTION OF THE DRAWINGS

Whenever the same feature is shown in the figures, it is labelled with the same reference number.

DESCRIPTION OF THE PREFERRED EMBODIMENT

Figure 1:
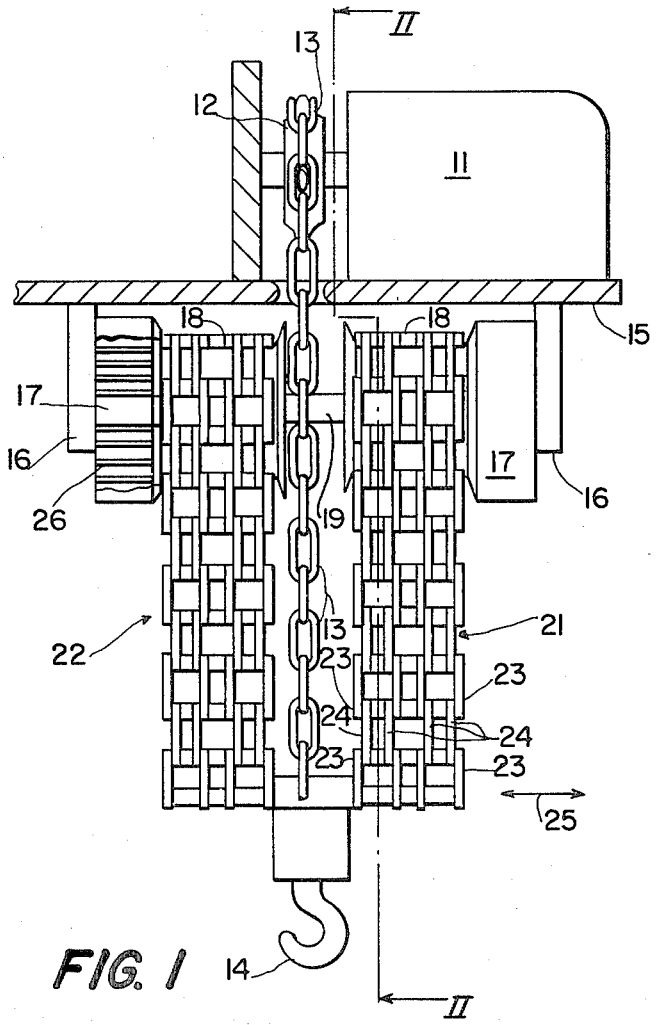
FIG. 1 shows a plane view of one embodiment of the anti-sway device as mounted on a conventional hoist.
Figure 2:
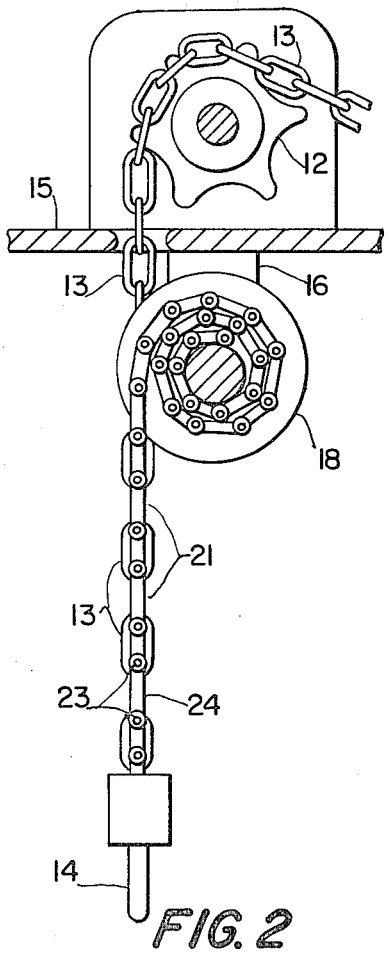
FIG. 2 is a cross-sectional view of the anti-sway device shown in FIG. 1.

FIGS. 1 and 2 illustrate one embodiment of the anti-sway device as it would be installed on a typical prior art hoist. The hoist comprises the sprocket drive 11, mounted on the platform 15, which turns the sprocket 12, raising or lowering the chain 13 attached to the hook 14. The chain 13, which could also be a cable, roller chain, or rope, will be referred to as the lifting line and the lower end of the chain including the hook 14 will be referred to as the suspended end or the free end of the lifting line. Mounted immediately below the platform 15 by means of brackets 16, are the two takeup reels 18 from which the two roller chains 21 and 22 are unwound. These reels are fixedly mounted on a common shaft 19. At the suspended end of the lifting line 13 near the hook 14, the roller chains 21 and 22 are attached to opposite sides of the hook 14. Each roller chain consists of multiple sets of links such as the set of four links 24, with each set of links connected together by pins and rollers such as at the connections 23. The number of links in each set will determine the number of strands in the roller chain. Each of the two roller chains shown in FIG. 1 has three strands. Additional strands could be added to each of the roller chains to make them wider and thus stiffer by simply adding additional links to each set of links in the chain. As is well known, such a roller chain will be very stiff and resistant to flexing in any direction which is parallel to the pivotal axis of it's rollers such as in the directions indicated by arrows 25. The roller chain must, of course, be very flexible in directions perpendicular to the arrows 25 so that it will easily wrap around the takeup reels 18. The two drums 17, attached to the takeup reels 18, contain large spiral springs 26 or other appropriate means which will apply a biasing torque to the takeup reels 18 to cause them to lift up on the roller chains to prevent the chains from going slack when the hook is raised. One end of each such spiral spring 26 is attached to a bracket 16, and the other end attached to the shaft 19, on which the takeup reels 18 are mounted. Since both of the takeup reels are fixedly mounted on the same shaft, it will not be possible for the takeup reels to counter rotate and thereby allow the suspended end of the chains to sway. It would also be possible to mount the two takeup reels on separate shafts which are not connected or which are connected only by a torsional friction brake.

Figure 3:
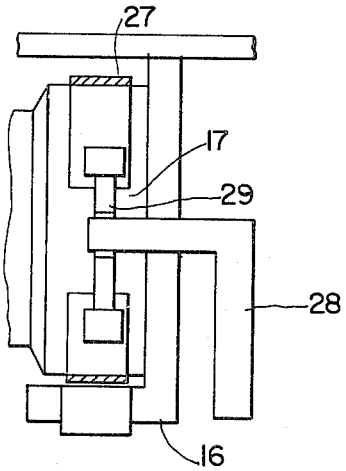
FIG. 3 is a view showing a drum brake adaptation of the takeup reel.
Figure 4:
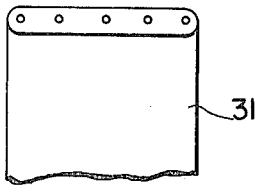
FIG. 4 is a showing of a belt or tape which could be substituted for the roller chain.

Several other embodiments of the anti-sway device may be used in place of or in addition to the one shown in FIGS. 1 and 2. The device could be built to have only one roller chain and retracting spring or the device could be built to have three or more roller chains and three or more retracting springs. Whereas the anti-sway device shown in the figures will prevent swaying in only one plane the device could be built to prevent sway in any direction by positioning two roller chains so that the axes of their rollers are perpendicular to each other. In the case, the takeup reels and the retracting springs of each pair of roller chains would have to be mounted on separate shafts. Instead of using the retracting springs 26, to eliminate slack in the roller chains, one could install a mechanical linkage between the shaft 19 and the sprocket 12, such as a slip clutch, so that as the sprocket drive 11 raises and lowers the lifting 13, it would also raise and lower the roller chains. One could also install a parking brake comprising band 27, lever 28 and linkage 29 of any conventional design between the brackets 16 and the shaft 19 or drum 17 (FIG. 3), to prevent the roller chains from unreeling when the hoist is not in operation. Such a parking brake can also be designed as a 100% safety back up device capable of holding the load entirely if the sprocket drive 11, sprocket 12 or lifting line 13 should fail. The lifting line 13 may also take the form of a roller chain but with the axis of its rollers and its sprocket 12 perpendicular to the plane of chains 21 and 22 so that the load lifting line 13 itself would also perform the dual function of anti-sway device. One or more of the lifting and anti-sway lines may be replaced by relatively wide belts or tapes, such as shown in sectional at 31 (FIG. 4), which may contain reinforcements such as wires, lines, or chains. The brackets 16 may also contain elastic elements or be attached to elastic elements which yield or deflect when the anti-sway system is subjected to excessive lateral forces. The springs contained in drums 17 may also be pneumatic, hydraulic or rubber.

Obviously many modifications and variations of this invention are possible in light of the above teachings. It is therefore to be understood that within the scope of the following claims the invention may be practiced otherwise than as specifically described.

What is claimed is:

1. An anti-sway device for stabilizing the free end of a lifting line suspended from a lifting apparatus comprising:

at least one retractable roller chain suspended parallel and adjacent to the lifting line, the suspended end of said chain being attached to the line near its free end, whereby the chain provides to the free end of the line a stiffness and resistance to lateral movement in a direction parallel to the pivotal axes of the chain's rollers;

a takeup reel for storing the unsuspended portions of the roller chain; and a means for exerting a biasing torque on the reel to cause the reel to takeup any slack which occurs in the roller chain.

2. The anti-sway device of claim 1 wherein the device includes a plurality of roller chains, a plurality of takeup reels and a plurality of means for exerting biasing torque on the takeup reels.

3. The anti-sway device of claim 2 wherein at least one roller chain is supsended so that its roller's axes extend perpendicular to the roller axes of at least one other roller chain whereby said roller chains provide the free end of the line with resistance to lateral movement in two directions.

4. The anti-sway device of claim 2 or 3 wherein said means for exerting a biasing torque on the takeup reels is a spring.

5. The anti-sway device of claim 1, 2, or 3 wherein each roller chain has a plurality of strands.

6. The anti-sway device of claim 1, 2, or 3 wherein the takeup reels for at least one of the roller chains are provided with an emergency brake.

7. An anti-sway device for stabilizing the free end of a lifting line suspended from a lifting apparatus comprising:

a retractable means having a stiffness in the plane of its width and being flexible in a direction perpendicular to the width with one end suspended parallel and adjacent to the lifting line, the suspended end of said retractable means being attached to the line near its free end, whereby said retractable means provides to the free end of the line a stiffness and resistance to lateral movement in any direction parallel to the width axis of said retractable means;

a takeup reel for storing the unsuspended portions of said retractable means;

a means for exerting a a biasing torque on the reel to cause the reel to takeup any slack which occurs in said retractable means.

8. A method of reducing sway in a lift line of a hoist system having a load and load carrying means attached to one end of the lift line comprising the steps of:

attaching a member which travels substantially the same distance as the lift line;

constructing said member to be stiff in one plane and flexible in a plane at right angles to the one plane; and providing means to extend and retract the member as the lift line is extended and retracted.

9. A method of reducing sway in a lift line of a hoist system having a load and load carrying means attached to one end of the lift line comprising the steps of:

constructing the lift line to having a much greater width than thickness and to be flexible in a plane at right angles to the width thereof, such that the lift line is stiff in one plane and flexible in a plane at right angles to the one plane.

* * * * *